United States Patent [19]

Pack et al.

[11] Patent Number: 4,839,972

[45] **Date of Patent: * Jun. 20, 1989**

[54] FOOTWEAR WITH PIVOTAL TOE

[76] Inventors: Roger N. Pack, Box 841, Edwards, Colo. 81632; Eddress Ahmad, Box 725, Avon, Colo. 81620

[ * ] Notice: The portion of the term of this patent subsequent to Jul. 7, 2004 has been disclaimed.

[21] Appl. No.: 70,708

[22] Filed: Jul. 7, 1987

Related U.S. Application Data

[63] Continuation-in-part of Ser. No. 835,038, Feb. 28, 1986, Pat. No. 4,667,769.

[51] Int. Cl.[4] ..... A43B 5/04

[52] U.S. Cl. ..... 36/117; 36/120; 36/114

[58] Field of Search ..... 36/117–121, 36/72 R, 77 R, 114; 280/614

[56] References Cited

U.S. PATENT DOCUMENTS

| | | | |
|---|---|---|---|
| 4,261,114 | 4/1981 | Viletto | 36/120 |
| 4,281,468 | 8/1981 | Gilbe et al. | 36/121 |
| 4,476,640 | 10/1984 | Aldinio et al. | 36/121 |
| 4,677,769 | 7/1987 | Ahmad et al. | 36/117 |

FOREIGN PATENT DOCUMENTS

| | | | |
|---|---|---|---|
| 0053340 | 6/1982 | European Pat. Off. | 36/117 |
| 0167765 | 1/1986 | European Pat. Off. | 36/117 |
| 2001297 | 10/1970 | Fed. Rep. of Germany | 36/117 |
| 2446066 | 4/1976 | Fed. Rep. of Germany | 36/120 |
| 2925554 | 1/1981 | Fed. Rep. of Germany | 36/117 |
| 3336063 | 4/1984 | Fed. Rep. of Germany | 36/117 |
| 3529209 | 2/1986 | Fed. Rep. of Germany | 36/117 |

*Primary Examiner*—James Kee Chi

*Attorney, Agent, or Firm*—Timothy J. Martin; J. Preston Oxenham

[57] ABSTRACT

An article of footwear, expecially adapted as a ski boot or hiking boot, has a toe portion and a heel portion respectively having a first and second sole portion that are pivotally rotatable with respect to one another over a fairly large angular range about a hinge between a first position wherein the first and second sole portions are substantially parallel and a second flexed position. The hinged fixedly interconnects the toe and heel portions in a manner preventing relative torsional rotation, and a downward limit stop prevents hyperextension of the foot. An upward limit stop may be included to prevent hyperflexion of the foot. The toe and heel portions may be independent pieces; and a masking panel extends therebetween beneath the foot. Likewise, an upper baffle may extend across the top of the foot between the toe and heel portions. Extension linkage my be employed as part of the hinge.

8 Claims, 8 Drawing Sheets

FOOTWEAR WITH PIVOTAL TOE

BACKGROUND OF THE INVENTION

This application is a continuation-in-part of our application, Ser. No. 835,038 filed Feb. 28, 1986 and now U.S. Pat. No. 4,677,679. This application is also related to our copending application Ser. No. 037,531, filed Apr. 13, 1987.

The present invention is directed to articles of footwear, and in particularly, to footwear having relatively stiff upper shells mounted to a sole. Accordingly, the present invention has specific application in the ski and hiking boot industries.

The technology developed in the skiing industry in recent times has been quite fast paced, with improvements being made to skis, bindings and the boots. One area of interest has been the interrelationship between alpine, or "downhill", skiing and nordic, or "cross-country", skiing. In alpine skiing, a rigid ski boot is locked into front and rear bindings on a relatively wide ski that is provided with cutting edges for permitting fast turns on steep downgrades. In alpine skiing, a typical ski boot has a completely rigid sole and a completely rigid upper shell that extends over the foot, around the ankle and over a portion of the lower leg. Such ski boots do not typically have the ability to flex so that the entire lower leg and foot of the human body is maintained in a relative unalterable configuration. Some ski boots, such as the boot shown in U.S. Pat. No. 4,461,103 issued July 24, 1984 to Annovi, provide a pivot between the foot shell and the ankle shell to allow limited relative movement. These boots often utilize resilient stiffening members so that resilient force may be applied by the skier to the toe portion of the foot by bending the knees forward against the resilient member.

On the other hand, in nordic skiing, it is important that a wide range of flexibility be maintained between the rear of the foot and the toe of the foot since nordic skiing has similarities to walking. In the past, typical nordic skiing boots or shoes have comprised a rather pliable leather article of footwear having a forward toe hinge that mounts in a front binding of a relatively narrow ski. The rear of the nordic boot is not secured to the ski so that the user may bend the boot along an area adjacent the ball of the foot. Indeed, for competent nordic skiing, it is necessary that the pivotal relationship between the toe and the heel of the foot exceed the typical range of flexing movement that takes place during walking.

One problem with nordic boots, however, has been their inability to resist torsional rotation about a longitudinal axis and their inability to resist lateral motion of the heel. This problem was recognized in U.S. Pat. No. 4,505,056 issued Mar. 19, 1985 to Beneteau. In the Beneteau patent, a cross-country ski boot is provided having a plurality of weakening ribs that extend adjacent the ball of the foot across the sides and top of thereof. To allow the boot to pivot, Beneteau encases his boot in a relatively stiff shell having a front toe portion and a rear heel portion separated and interconected by a flat, flexing region of the rigid shell. The shell is then pivotally attached to a ski binding so as to prevent torsional rotation and lateral movement of the heel.

In addition to the prior art devices noted above, many other inventors have recognized the lack of comfort generated by an inflexible alpine boot when the skier removes the skis and attempts to walk from one location to another. To this end, there have been numerous developments of ski boots which flex slightly to allow greater ease in walking. On such prior art device is shown in U.S. Pat. No. 3,972,134 to Kastinger wherein a boot having a stiff sole and a rigid upper shell includes regions of reduced strength at a fore part of the foot to allow bending of the foot forwardly of the ankle, and pleats are provided at a forward part of the ankle to facilitate walking. U.S. Pat. No. 3,535,800, issued Oct. 27, 1970 to Stohr, shows a ski boot that flexes about a pivot on the ankle with this flexing accomplished by baffles extending forwardly and rearwardly of the boot at the ankle region. U.S. Pat. No. 3,953,930, issued May 4, 1976 to Ramer, also discloses a ski boot designed for greater ease in walking. In the Ramer structure, a flexible sole is provided to support a rigid shell defining a heel portion and a forward foot portion, with the forward foot portion being telescopically inserted into a rigid shell defining a toe portion for the boot. As the skier walks in this boot, the toe portion and the heel/-foot portion telescope with respect to one another. Limit stop means for preventing hyperextension of the floating toe portion is provided to limit relative movement between the toe portion and the heel portion.

Despite the improvements of these prior art patents over earlier ski and hiking boots, there remains the need for a boot that may be employed for both alpine skiing and for nordic skiing, which boot allows pivotal or rotational movement about the ball of the foot while at the same time remaining rigid against torsional rotation and lateral movement of the heel when the toe portion is secured to a front ski binding. There is further a need that allows greater flexibility of pivotal movement between the toe portion and heel portion so that nordic style skiers may implement telemark turns on relatively steep downgrades. There is further a need to provide a boot that can be used for both nordic skiing, alpine skiing and for walking which boot is acceptable in a wide variety of typical bindings.

SUMMARY OF THE INVENTION

It is therefore an object of the present invention to provide a novel and useful article of footwear having independent toe and heel portions that are pivotally rotatable with respect to one another over a fairly large angular range.

It is a further object of the present invention to provide an article of footwear wherein independent toe and heel portions are pivotally connected to one another about the axis of the ball of the foot so as to allow relative ease in walking even when such boot is constructed of rigid materials.

Yet another object of the present invention is to provide an article of footwear wherein the independent toe and heel portions so that they are pivotally rotatable with respect to one another include hyperextension limit stop structure to prevent hyperextension of the human foot placed therein.

Yet another object of the present invention is to provide an article of footwear wherein the independent toe and heel portions are pivotally rotatable but include an adjustable hyperextension limit stop structure.

A still further object of the present invention is to provide an article of footwear which includes upper and lower baffle structure to prevent the ingress of unwanted materials into the article during use.

In order to accomplish these objects, the preferred embodiment of the present invention is directed to an article of footwear adapted to receive the human foot and operative to prevent torsional rotation of the foot while preventing bending movement about the ball of the foot. To this end, the broad form of the present invention includes a toe portion having a first sole portion and a relatively rigid first upper shell. The toe portion is configured to extend around and enclose a forward part of the human foot from a forward tip receiving the toes rearwardly to a location just behind the ball of the foot. An independent heel portion includes a second sole portion and a relatively rigid second upper shell with the second upper shell having an access opening to permit insertion and removal of the foot. The second upper shell extends around the rear of the foot and forwardly to a location approximately the ball of the foot so that the second upper shell and the second sole portion encloses a rearward part of the foot between the heel and the ball thereof. A hinge means interconnects the toe portion and the heel portion to permit relative rotational movement about a fixed rotational axis with this rotational axis being in an axis plane generally parallel to the first sole portion. Preferably, the hinge means comprises a pair of oppositely projecting trunnion pins received in bearings with the trunnion pins and bearings interconnecting the toe and heel portions. The hinge permits pivotal movement between a flat position wherein the first and second sole portions are substantially oriented in parallel planes, and a second, flexed position, wherein the planes of the first and second sole portions are at an angle with respect to one another. The hinge may also include expansion linkage to help avoid unwanted binding or pinching of the foot during wear.

The relatively stiff upper shells prevent both torsional rotation and lateral movement of the heel portion when the toe portion is secured. When this article of footwear comprises a ski boot, this structure allows both alpine skiing and nordic skiing. When used in the nordic syle, the rigidity of the upper shells permits substantial control over the nordic ski believed to be not heretofore obtained. When the footwear is used for skiing, an upper protective sheath or baffle extends between a wedge-shaped cut out between the upper shells of the toe and heel portions to prevent the ingress of snow or other unwanted materials. Likewise, a lower bottom baffle is mounted in and extends between the first and second sole portions. This baffle may either slide in the sole portions or may be fabricated of a stretchable material. Similarly, in order to prevent hyperextension of the boot and foot, an adjustable limit stop is provided. The lower baffle, in turn, helps prevent hyperflexion of the boot.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention relates to various articles of footwear which have relatively stiff upper shells which would normally limit the motion between the toes, foot and ankle. As such, the present invention has particular applicability to ski boots and hiking boots. However, it should be appreciated by one ordinarily skilled in the art that the many features described and claimed herein can extend to a variety of types of footwear in addition to those specifically mentioned.

Figure 1:
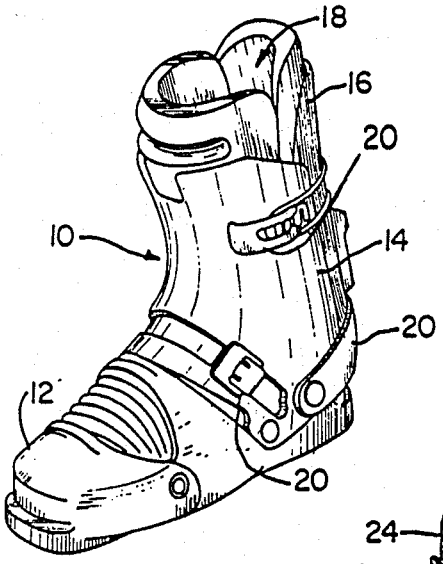
FIG. 1 is a perspective view of an article of footwear, in the form of a ski boot, according to the preferred embodiment of the present invention.

In FIG. 1, a ski boot 10 is shown having a toe portion 12 and a heel portion 14 with heel portion 14 having an upward extension 16 adapted to encircle the lower leg of the wearer. Toe portion 12, heel portion 14 and upward extension 16 define a cavity to receive the human foot and lower leg through access opening 18. When received by boot 10, a forward part of the human foot including the toes and the portion of the foot generally known as the "ball" is received in toe portion 12. That part of the foot extending from the ball of the foot to the heel, and the lower leg and ankle area, is received in heel portion 14, including upper extension 16. Suitable fastening clamps 20, not forming part of this invention, are provided to fasten the ski boot 10 around the foot, as is known in the art.

Figure 3:
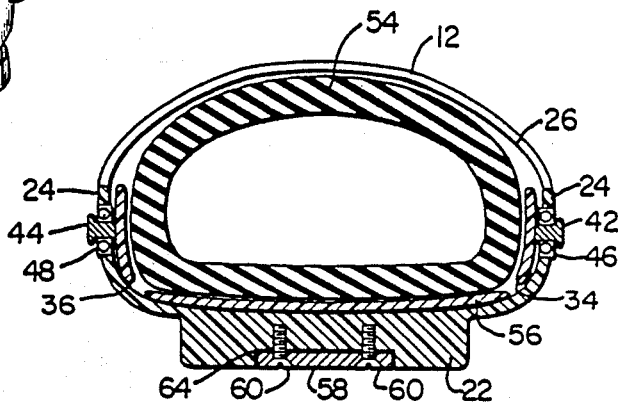
FIG. 3 is a cross-sectional view taken about lines 3—3 of FIG. 2.
Figure 2:
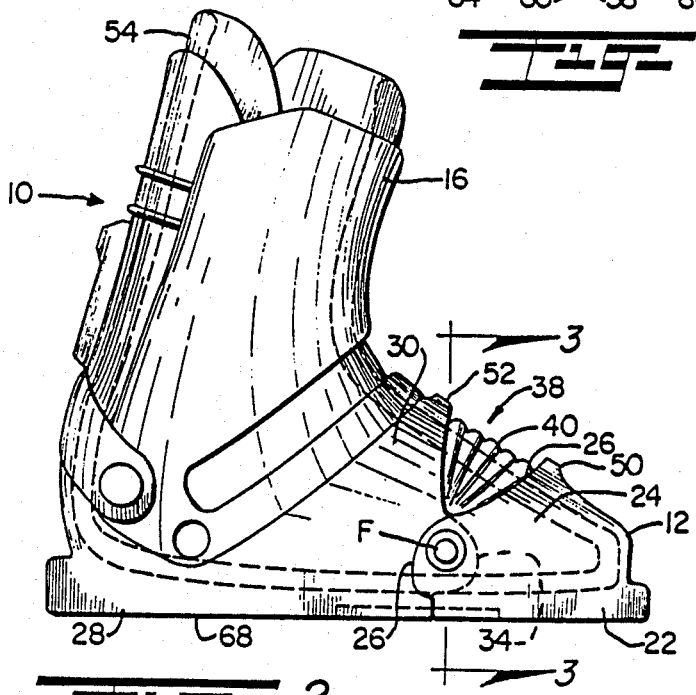
FIG. 2 is a side view in elevation of the ski boot shown in FIG. 1 shown in the flat position.

The more detailed features of ski boot 10 are shown in FIGS. 2 and 3. In FIG. 2, toe portion 12 includes a first sole portion 22 that defines a first plane, and a sole portion 22 is secured to a relatively rigid first upper shell 24. Toe portion 12 terminates in a rear edge 26 that extends from the top of the foot downwardly and rearwardly behind the ball of the foot. Heel portion 14 includes a second sole portion 28 that defines a second plane, and sole portion 28 is secured to a relatively rigid second upper shell 30 and terminates at a forward edge 32 that extends downwardly from the top of shell 30 and forwardly of the ball of the foot. Accordingly, heel portion 14 has a side wing on either side of boot 10, such as side wings 34 and 36 shown in FIG. 3. Forward edge 32 and rear edge 26 define a wedge-shaped cut out region 38 between toe portion 12 and heel portion 14, with this cut out region 38 being protected by a pleated baffle member or shield 40 that prevents ingress of unwanted material into the ski boot cavity.

It should be appreciated that toe portion 12 and heel portion 16 are structured independently of one another but are rotateably connected by hinge means as is shown in FIGS. 2 and 3. In these figures, a pair of trunnion pins 42 and 44 extend laterally outwardly from side wings 34 and 36, respectively, and are rotateably received in bearings 46 and 48 mounted in suitable lateral openings on the lateral sides of first upper shell 24 adjacent rear edge 26 so that trunnion pins 42, 44 and bearings 46, 48 are located on either side of the ball of the foot above the common plane of sole portion 22 and sole portion 28 when the sole portions are in the flat position shown in FIG. 2.

It should be understood, then, that toe portion 12 and heel portion 14 may rotate with respect to one another about the rotational axis defined by trunnion pins 42 and 44 to pivot with respect to one another. In order to prevent excessive pivotal motion, limit stop means are provided in the form of a first post 50 upwardly projecting from upper shell adjacent edge 26, and a second post 52 upwardly projecting from second upper shell 30 adjacent edge 32. A liner 54 is positioned within the cavity of the ski boot, as is common in the art, and a relatively stiff yet pliable pad 56 that underlies between liner 54 and sole portions 22 and 28. As will be discussed more thoroughly below, pad 56 yieldably resists relative rotation of the toe and heel portions.

Figure 4:
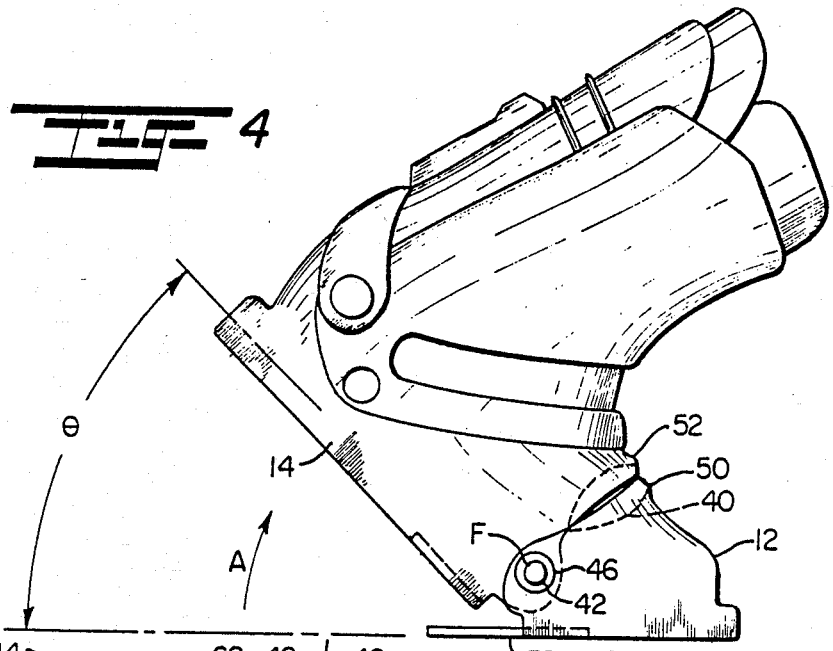
FIG. 4 is a side view in elevation of the ski boot shown in FIG. 2 shown in the flexed position.
Figure 5:
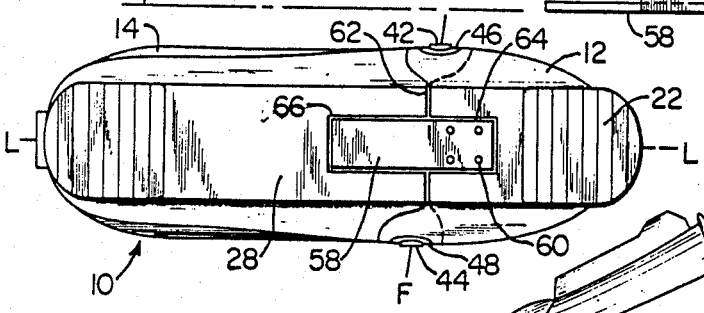
FIG. 5 is a bottom plan view of the ski boot shown in FIG. 2 in the flat position.

Referring now to FIGS. 2–4, it should be appreciated that toe portion 12 and heel portion 14 may be rotated between a flat position shown in FIG. 2, and a flexed position shown in FIG. 4. As noted above, posts 50 and 52 provide limit stop means so that, as is shown in FIG. 4, when the boot 10 is placed in the flexed position, post 52 will abut post 50 to prevent further angular movement in the direction of arrow "A". In the flexed position, pleat shield 40 is squeezed together, in an accordion-like manner whereas shield 40 is expanded in the flat position shown in FIG. 2. It is further desirable to limit relative rotation of toe portion 12 and heel portion 14 in a direction from a flexed position past a flat position in order to avoid hyperextension of the foot. To this end, a downward limit stop means is provided to operate in conjunction with the upper limit stop means provided by posts 50 and 52. As is best shown in FIGS. 3, 4 and 5, a downward stop may be provided conveniently by means of a rigid plate 58, preferrably formed out of steel or other rigid metal, with plate 58 being affixed to one of first and second sole portions 22 and 28. In FIGS. 2–5, plate 58 is secured by means of a plurality of screws 60 to first sole portion 22 of toe portion 12. Plate 58 extends rearwardly from screws 60 across separation region 62 between toe and heel portions 22 and 28. Plate 58 then extends rearwardly along second sole portion 28. In the preferred embodiment, as is shown in FIG. 5, plate 58 is mounted in a first depression 64 in first sole portion 22, and extends in a second depression 66 formed at a forward part of second sole portion 28. In this manner, as is shown in FIG. 2, when boot 10 is in the flat position, plate 58 is recessed with respect to bottom surface 68 of boot 10.

The operation of boot 10 may now be more readily appreciated and understood based on the foregoing description. In the flat position, toe portion 12 and heel portion 14 are rotated to receive the human foot in a normal, unflexed state so that sole portions 22 and 28 are substantiallly coplanar. Hyperextension is prevented by means of plate 58 which prevents relative rotation of the toe and heel portions past the flat position. In the flat position, ski boot 10 may be received in traditional alpine bindings and retained therein in a normal manner for control of the alpine ski. When the skier desires to walk, or use ski boot 10 for nordic skiing, toe portion 12 and heel portion 14, by virtue of the hinge means provided by the trunnion pins and bearings, is allowed to pivot forwardly as is shown in FIG. 4. While this is the normal walking position, it should be appreciated, that, for nordic skiing, toe portion 12 would be received in a standard nordic toe binding. Since toe portion 12 and heel portion 14 are formed as rigid shells, and are attached at two points along axis F, ski boot 10 has torsional stability even when used for nordic skiing. Further, as is shown in FIG. 5, when ski boot 10 is shown for a left foot, trunnion pin 42 lies forwardly of trunnion pin 44 so that axis F is located at an angle with respect to longitudinal axis L of ski boot 10. Further, as is shown in FIG. 2, axis F is positioned somewhat midway between sole portions 22 and 28 and the top of upper shells 24 and 30 so that axis F is oriented generally at the center of the ball of the foot. Particularly, the hinging of toe portion 12 to heel portion 14 is constructed so that axis F generally extends along the functional axis of the metatarsal phalangial joint articulation between the proximal phalanges and the metatarsals of the foot. Accordingly, axis F lies along the normal flex axis for the toes and the foot.

As noted above, pad 56 is relatively stiff, yet flexible, and is positioned between sole portions 22 and 28 and liner 54. When walking or using boot 10 for nordic skiing, the relative stiffness of pad 56 yieldingly resists the rotational movement of toe and heel portions 12 and 14, and thus the human foot placed in boot 10. Further, the resiliency of pad 56 tends to return boot 10 to the flat position. By selecting the stiffness and resiliency of pad 56, boot 10 may be cutomized for skiers of different weights and skiing abilities.

Figure 6:
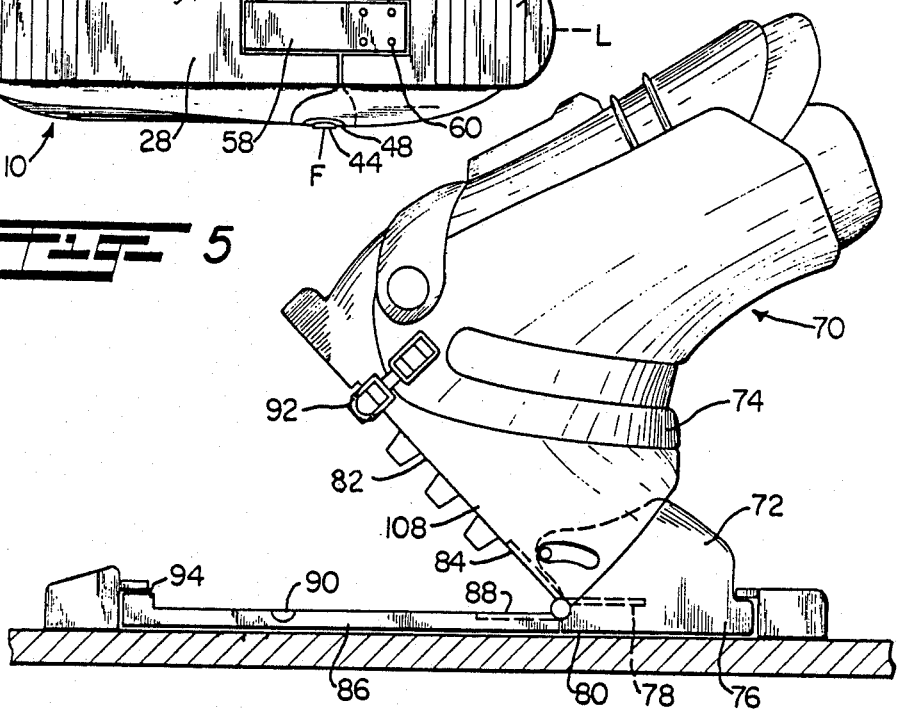
FIG. 6 is a side view in elevation of a first alternate embodiment of a ski boot according to the present invention, providing an auxillary sole plate and positioned in an alpine binding.
Figure 7:
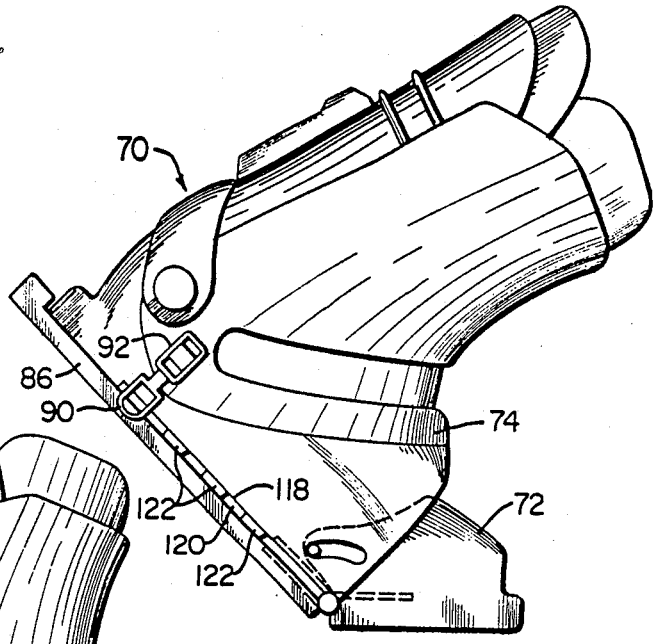
FIG. 7 is a side view in elevation of the ski boot shown in FIG. 6, in the flexed position, with the sole plate secured to heel portion of the ski boot.
Figure 8:
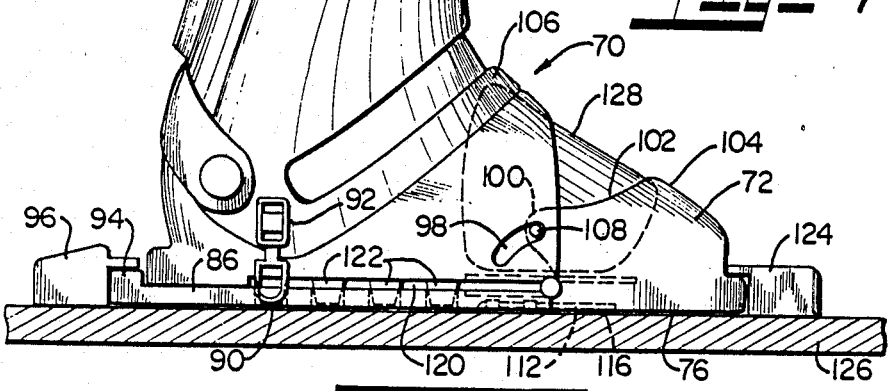
FIG. 8 is a side view in elevation of the ski boot shown in FIG. 6, with the ski boot now being positioned in an alpine binding.

A first alternate embodiment of a ski boot according to the present invention is shown best in FIGS. 6–8. In these figures, ski boot 70 includes a toe portion 72 and a heel portion 74. Toe portion 72 has a first sole portion 76 which is hingeably secured by wing 78 of hinge 80 to a second sole portion 82 of heel portion 74. Second sole portion 82 is secured to hinge 80 by means of wing 84 so that toe and heel portion 72 and 74 may relatively rotate with respect to one another as described with respect to the preferred embodiment. An auxillary sole plate 86 is also affixed to hinge 80 by means of wing 88 so that toe portion 72, heel portion 78 and auxillary sole plate 86 may rotate with respect to one another about the axis of hinge 80.

An auxillary sole plate 86 is also affixed to hinge 80 by means of wing 88 so that toe portion 72, heel portion 78 and auxillary sole plate 86 may rotate with respect to one another about the rotational axis of hinge 80. Auxillary plate 86 may be releaseably secured to heel portion 74 by means of mounting fingers 90 on plate 86 and releaseable clasps, such as clasp 92, on oppsite sides of heel portion 74. Thus, heel portion 74 and auxillary plate 86 may be secured to one another, as is shown in FIG. 7, for common movement; alternately, auxillary sole plate 86 may be released from heel portion 74 for independent movement therewith, as is shown in FIG. 6. Sole plate 86 terminates, at a rear edge, in a binding mount 94 that is adapted to be secured in a standard alpine rear binding, such as rear binding 96 shown in FIG. 8.

An alternate structure is provided for the forward and rearward stop means, as is shown in FIGS. 6–8. In this alternate embodiment, an arcuate slot, such as slot 98 is formed near the front of heel portion 74, on opposite lateral sides of boot 70. A pair of side wings, such as side wing 100 are formed as an extension of rear edge 102 of toe portion 72 with side wings 102 projecting into the cavity defined by second upper shell 106 of heel portion 74. Each side wing, such as wing 102, is formed as an extension of first upper shell 104, and each carries a pin 108 that is received in each slot 98 so that pin 108 may move along slot 98 during the pivotal motion with the relative rotation of toe portion 72 and heel portion 74 being limited by the abutment of pin 108 against the ends of slot 98.

Figure 9:
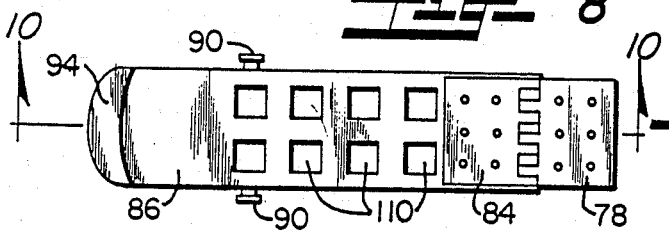
FIG. 9 is a top plan view of auxillary sole plate shown in FIG. 8.
Figure 10:
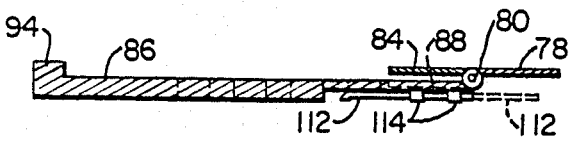
FIG. 10 is a cross-sectional view taken about lines 10—10 of FIG. 9.

Sole plate 86 is best shown in FIGS. 9 and 10 where it should be appreciated that auxillary sole plate 86 has a pair of oppositely projecting fingers 90 and is provided with a plurality of openings 110 which function as described below. Further, since it is desirable that auxillary sole plate 86 be locked in a substantially planar relationship with first sole portion 76, a locking means as shown in FIG. 10, and in phantom FIG. 8. This locking means comprises a relatively flat locking plate 112 that is slideably received in brackets 114 so that it may be slid from an unlocked position shown in FIG. 10 to a locked position shown in phantom in FIGS. 8 and 10. To this end, plate 112 may be received in a locking bracket 116, shown in phantom in FIG. 8, to prevent plate 86 from pivoting with respect to sole portion 76. As is shown in FIGS. 7 and 8, auxillary sole plate 86 is oriented in a substantially spaced parallel relation to the bottom surface 118 of heel portion 74 so that an opening 120 is located therebetween. Space 120 is provided since snow tends to build up on the underside of the boot 70. For this reason, openings 110 are provided so that snow may be removed from space 120. To this end, also, the bottom of heel portion 74 is provided with a plurality of projections 122 which are oriented to pass within at least some of openings 110 to eject snow accumulating therein.

The operation of boot 70 may now be more fully appreciated. When it is desired to alpine ski, boot 70 is placed with toe portion 72 in a standard front binding 124 with binding mount 94 of plate 86 being received in rear binding 96 on ski 126. In this configuration, plate 86 is secured, by a respective clasp 92 to a respective finger 90. Locking plate 112 is slid to engage locking brackets 116. This boot may now be used for alpine skiing. Should the skier desire to nordic ski, the skier simply unfastens clasps 92 from fingers 90, as is shown in FIG. 6. In this position, heel portion 74 may be rotated with respect to toe portion 72 within the limits provided by pin 108 in slot 98. For walking, boot 70 is detached from the ski bindings, and plate 86 is again attached to heel portion 74 by clasps 92 and pins 90, and locking plate 112 is released.

Figure 11:
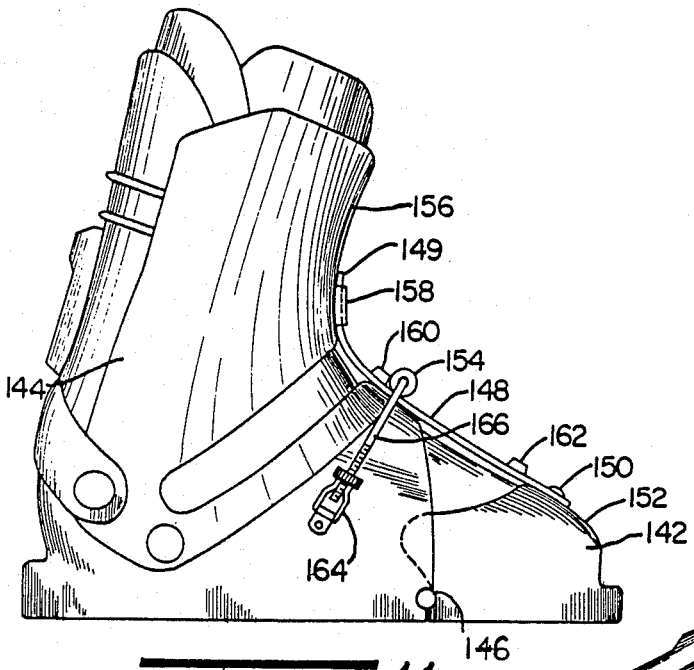
FIG. 11 is a side view in elevation of a second alternate embodiment of the present invention shown in the flat position.
Figure 12:
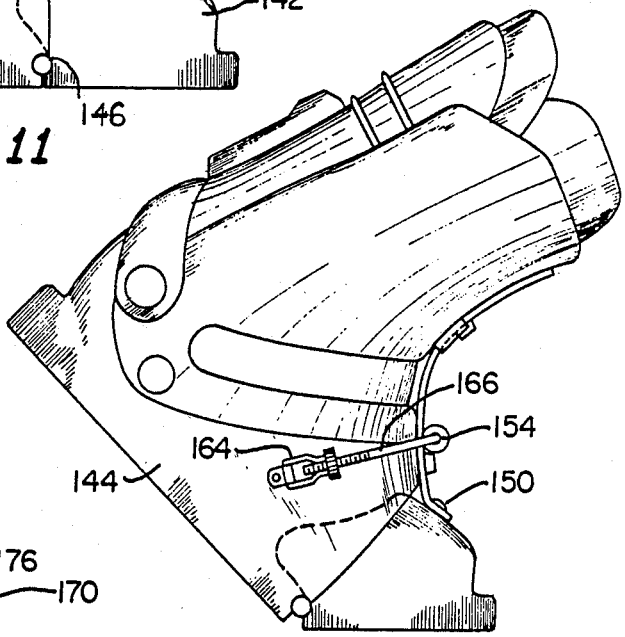
FIG. 12 is a side view in elevation of the ski boot shown in FIG. 11 in the flexed position.

A second alternate embodiment of the present invention is shown in FIGS. 11 and 12. Here, ski boot 140 includes toe portion 142 and heel portion 144 which are hinged together by means of hinge 146 in a manner similar to that described above. In this embodiment, though, a different means for yieldingly resisting the rotational movement of toe portion 142 and heel portion 144 as provided. Also, a different configuration for the forward and rearward limit stops are employed. In FIG. 11, a stiff but bendable strap 148 has a forward edge secured by means of screw 150 to first upper shell 152 of toe portion 142. Strap 148 extends rearwardly under a friction roller 154 along the upper surface of second shell portion 156 and upwardly through a guide bracket 158. A rearward limit stop comprises a rib 160 formed on strap 148 in order to prevent hyperextension of the toe and heel portions. Similarly, the forward limit stop in the form of rib 162 is also provided on strap 148. Thus, strap 148 may slideably pass under roller 154. To this end, it should be appreciated that bracket 158 is provided with a slot to provide rib 160 to pass therethrough.

In order to adjust the force resisting the rotational movement, a threaded nut assembly 164 is attached to the side wall of heel portion 144 so that the support arm 166 of roller 154 may be drawn toward threaded nut assembly 164 so that roller 154 applies greater frictional pressure on strap 148.

Figure 13:
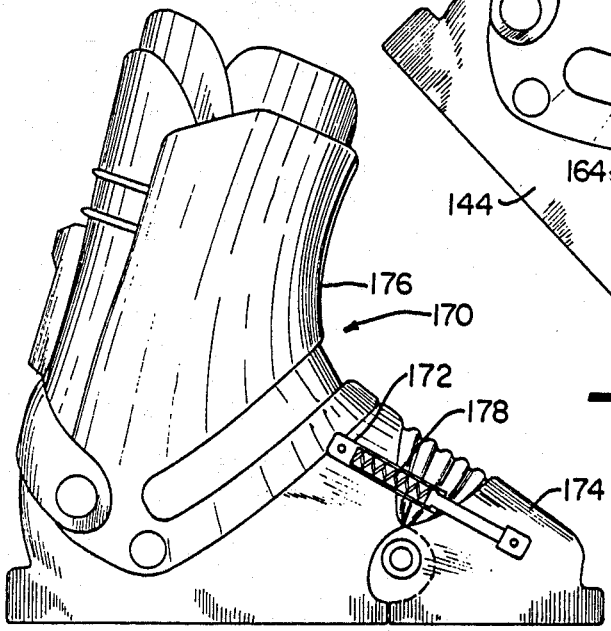
FIG. 13 is a side view in elevation of a third alternate embodiment of the present invention shown in the flat position.
Figure 14:
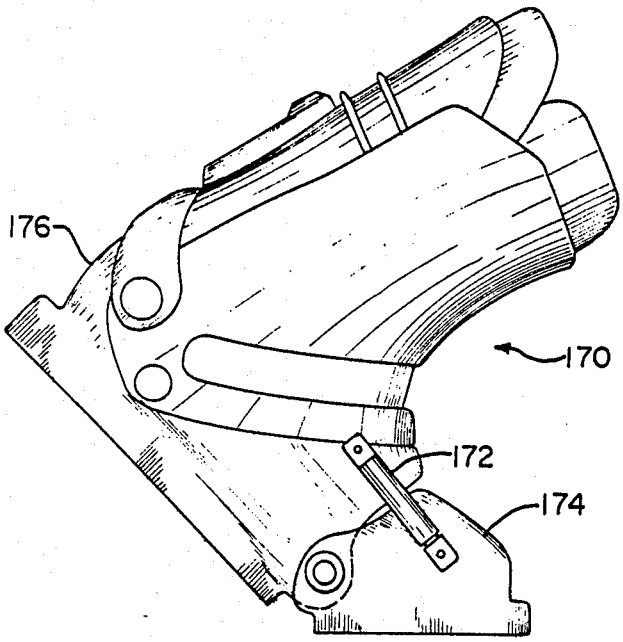
FIG. 14 is a side view in elevation of the ski boot shown in FIG. 13 in the flexed position.

A third alternate embodiment of the present invention is shown in FIGS. 13 and 14, with these figures showing a ski boot 170 having a construction similar to that described with respect to FIGS. 1–5. In FIGS. 13 and 14, though, a different means for resisting relative rotation is provided in the form of a pair of side mounted pistons, such as piston 172, extending between toe portion 174 and heel portion 176. Such pistons, such as piston 172, may be spring actuated as is shown by spring 178 to ordinarily increase the resistance to rotational force as the boot 170 moves from the flat position shown in FIG. 13 to the flexed position shown in FIG. 14. Pistons 172 could, if desired, be fluid actuated pistons, such as liquid shock absorbers or air cylinders.

Figure 15:
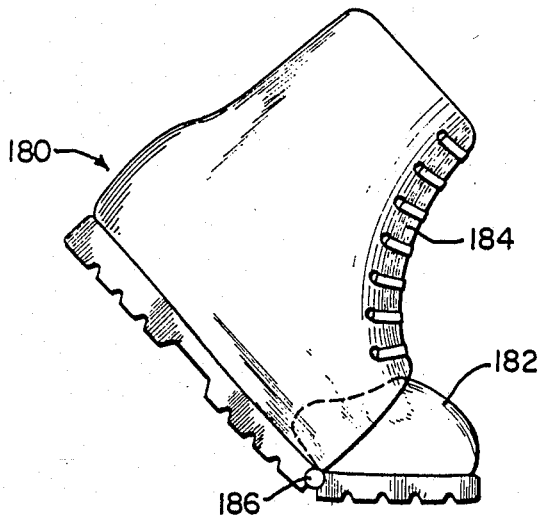
FIG. 15 is a fourth alternate embodiment of the present invention, in the form of a hiking boot, in the flexed position.

A fourth alternate embodiment, in the form of hiking boot 180, is shown in FIG. 15. Here, again, toe portion 182 is secured to heel portion 184 by means of a sole mounted hinge 186 so that boot 180 is more comfortable for walking while maintaining its torsional stability.

Figure 16:
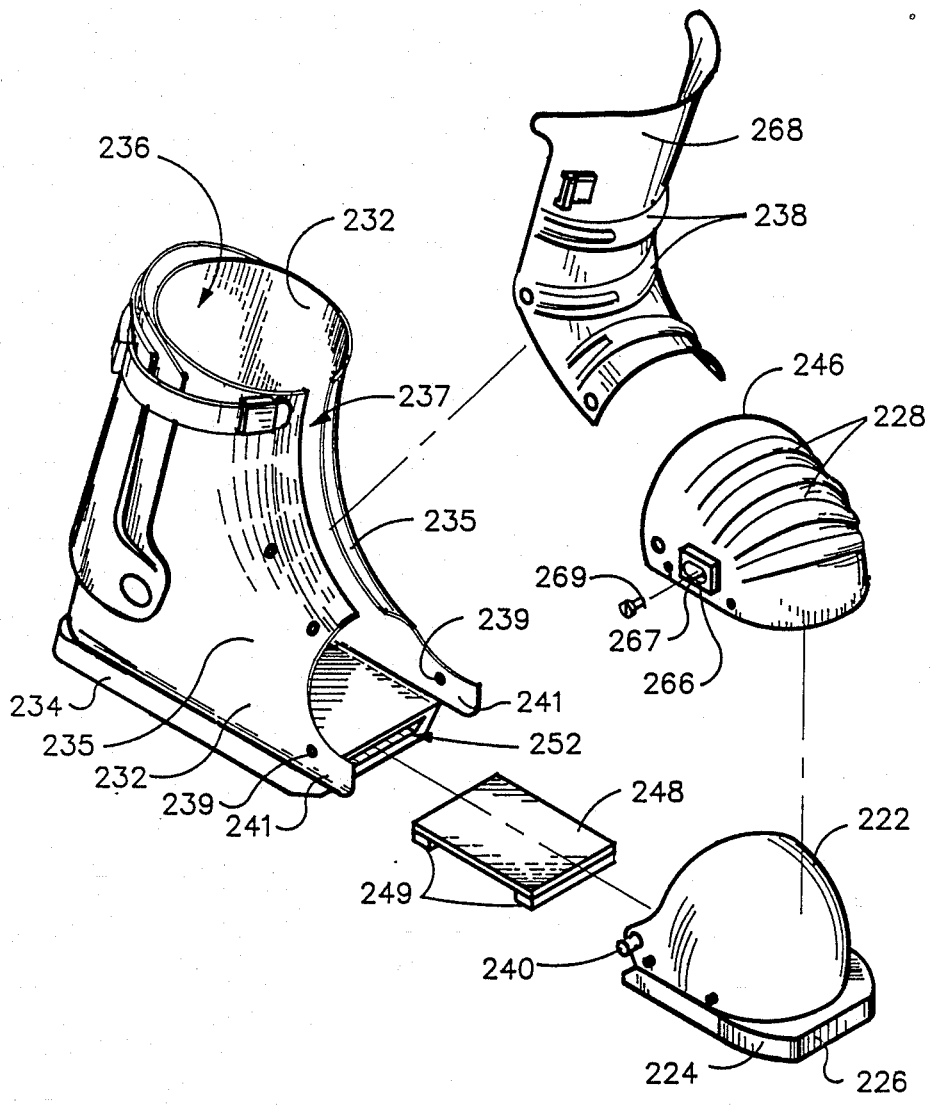
FIG. 16 is an exploded perspective view of a fifth alternate embodiment of the present invention showing adjustable hyperextension structure.
Figure 17:
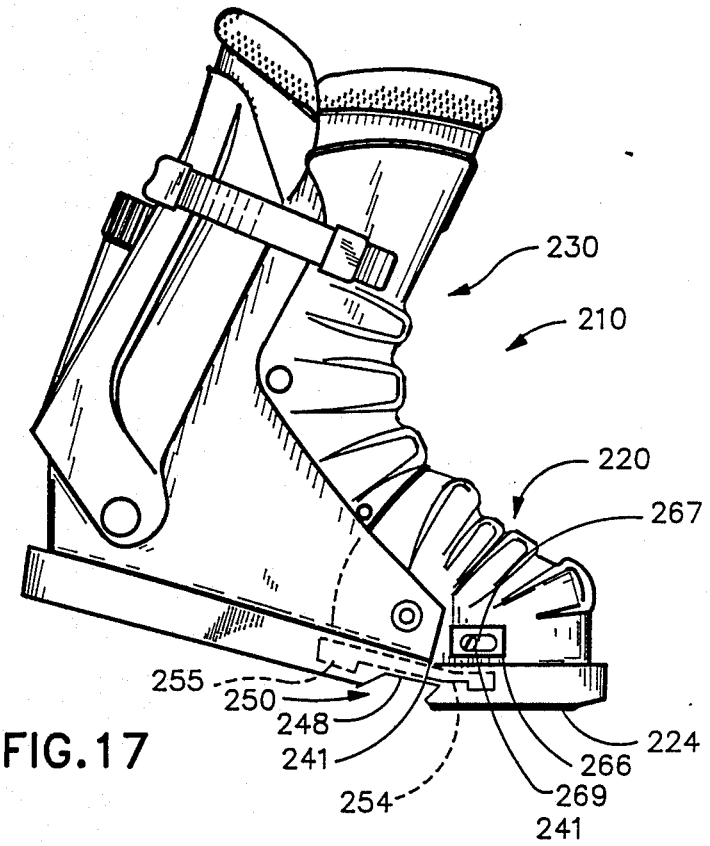
FIG. 17 is a side view in elevation of the assembled boot shown in FIG. 16.

A fifth embodiment of the present invention is shown in FIGS. 16 and 17 and includes one improvement in the form of an adjustable limit stop to prevent hyperextension of the boot and the foot placed therein and another improvement in form of a lower masking panel that helps prevent the ingress of unwanted materials into the interior of the boot. In the embodiment shown in FIGS. 16 and 17, the ski boot 210 includes a toe portion 220 and a heel portion 230. Toe portion 220 includes a relatively rigid upper toe shell 222 which is integrally formed and relatively rigid with respect to lower toe sole 224. Lower toe sole 224 terminates in a forward tip 226 adapted to be received and engaged by the front binding of a ski. A toe baffle 246 forms part of toe portion 220 and has pleats 228 to allow flexing of the upper portion of toe baffle 226. Heel portion 230 includes a relatively rigid upper rear shell 232 and a rear sole 234. Rear shell 232 has an upwardly located longitudinal split 237 which separates the upper portion of rear shell 232 into a pair of side panels 235. An ankle baffle 268 is attached to rear shell 232 across split 237 and has additional pleats 238 in order to allow flexing at the ankle area of the foot. Pleats 228 and pleats 238 run transversely across the upper surface of ski boot 210. Toe portion 220 and heel portion 230 are hinged together, such as by a trunnion pin hinge 240 similar to that described above with respect to the preferred embodiment of the present invention. Accordingly, heel portion 230 pivots with respect to toe portion 220 about hinge 240 between a relatively flat position and a flexed position, as described above.

The embodiment shown in FIGS. 16 and 17 includes an adjustable downward limit stop to prevent hyperextension. To this end, it should be appreciated that each of side panels 235 are provided with holes 239 which receive trunnion pin hinges 240, and each panel 235 includes an arm 241 that projects forwardly of hinge 240. Toe portion 220 is provided with a pair of adjustable blocks, such as block 266 which is secured by means of a screw 269 to toe portion 220. Block 266 includes a slot 267 through which tightening screw 269 extends. Accordingly, block 266 can be longitudinally positioned at selected positions to determine the location at which each arm 241 abuts the block to define the location of the limit stop when toe portion 30 is pivoted to advance arm 241 into the abutted relationship with block 266.

Figure 18:
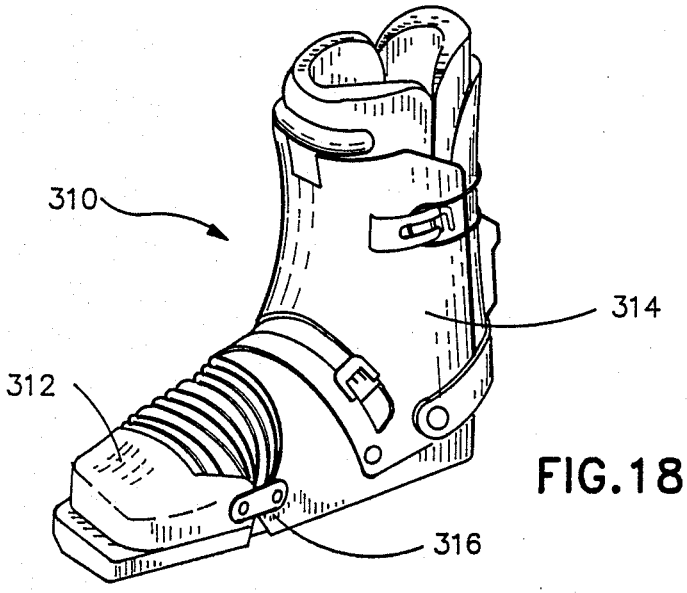
FIG. 18 is a perspective view of a sixth alternate embodiment of the present invention showing expansion linkage structure.
Figure 19:
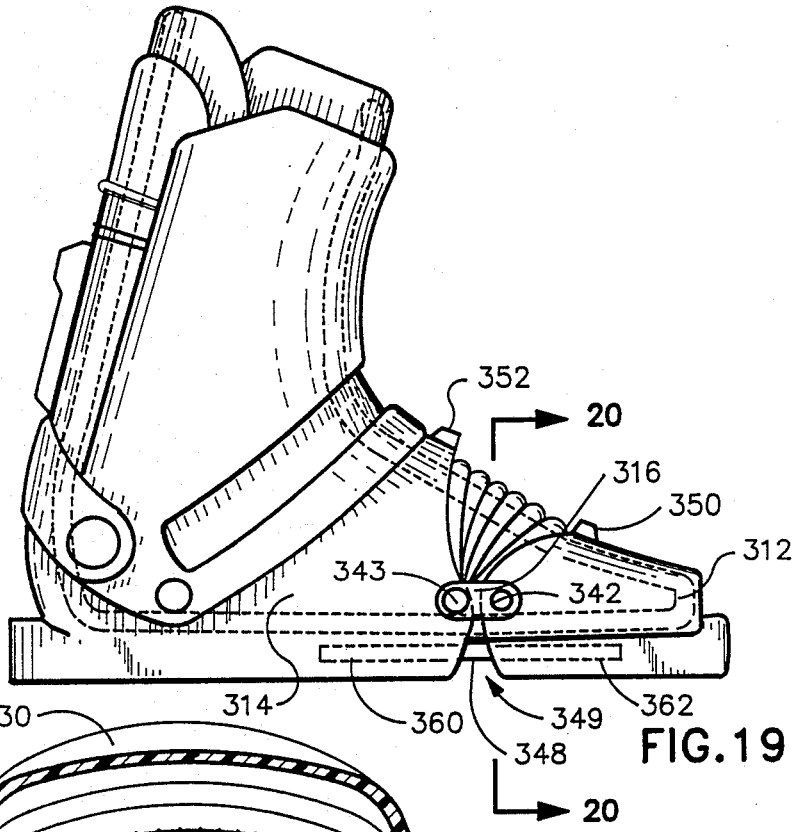
FIG. 19 is a side view in elevation of the boot shown in FIG. 18.
Figure 20:
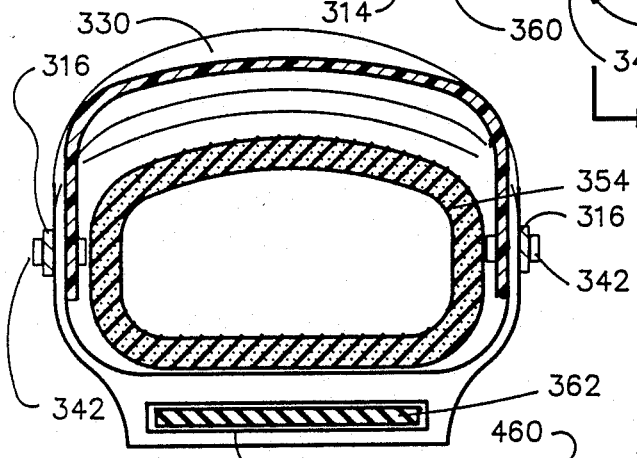
FIG. 20 is a cross-sectional view taken about lines 20—20 of FIG. 19.

As is shown in FIGS. 16 and 17, toe shell 222 and toe sole 224 are formed as a unit independently of heel shell 232 and heel sole 234. Accordingly, an open region 250 separates the toe and heel portions. In order to prevent the unwanted ingress of dirt, snow and other materials, a lower masking panel is provided to extend across separation region 250 beneath the foot. To this end, a flexible masking panel 248 is provided which is adapted to be received in a pair of facing cavities respectively formed in toe sole 224 and heel sole 234. Thus, as is best seen in FIG. 16, such cavity 252 is sized to receive masking panel 248 and as is shown in FIG. 17, a cavity 254 is formed in toe sole 224 to receive masking panel 248. In order to secure panel 248 in position, a forward and rearward edge of panel 248 terminates in downwardly extending shoulders 249 which innerlock in similar slots such as slot 255 shown in phantom in FIG. 17. Accordingly, masking panel 248 is constructed of a stretchable material. However, it should be appreciated that panel 248 could be formed of a flexible but nonstretchable material that would merely slide within cavities 252 and 254. Yet another embodiment of the present invention is shown in FIGS. 18–20. Here, ski boot 310 is constructed almost identically as that described with respect to ski boot 10 of the preferred embodiment described above. In ski boot 310, however, toe portion 312 is pivotally mounted to heel portion 314 by means of expansion linkage defined by links 316. Toe portion 312 is pivotally connected to a first end of each extension link 316 and the heel portion is pivotally connected to a second end of the extension link 316. Thus, a forward portion of each link 316 receives trunnion pin 342 and a rearward portion of link 316 receives a similar trunnion pin 343. The toe and heel portion are therefore pivoted with respect to one another on a pair of pivot axes. Upward limit stops in the form of blocks 350 and 352 are provided to prevent hyperflexion of ski boot 310 and a sliding masking panel 348 is provided to mask separation region 349 between toe portion 312 and heel portion 314. Sliding panel 348 is received in cavities 360 and 362 and again an upper baffle 330 is provided along with a liner 354.

Figure 21:
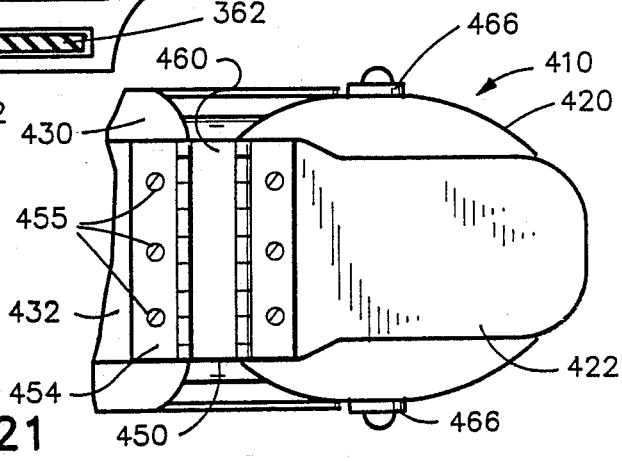
FIG. 21 is a bottom plan view of the front toe portion of another embodiment of expansion linkage for use with the present invention.

Finally, an alternate embodiment of the expansion linkage for a ski boot is shown in FIG. 21. Here, the trunnion pin and link arrangement is replaced by alternate structure. In the embodiment shown in FIG. 21, the hinge means includes a double plate hinge 450 having a forward plate 452 secured by screws 451 to sole portion 422 of toe portion 420. A rear plate 454 is secured to sole portion 432 of heel portion 430 by means of screws 455. An intermediate extension plate 460 pivotally interconnects plates 452 and 454. To this end, intermediate plate 460 is pivotally secured at a forward edge to forward plate 452 and pivotally secured at a rearward edge to rear plate 454. A dual pivot axis arrangement is thus obtained by this three plate structure. Adjustable blocks 466 again provide an adjustable hyperextension block in a manner similar to that described with respect to the embodiment shown in FIGS. 16 and 17.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

We claim:

1. An article of footwear adapted to receive the human foot and operative to prevent torsional rotation of the foot while permitting bending movement about the ball of the foot, comprising:

a toe portion having a first sole portion and a first relatively rigid upper shell, said first sole portion and said first upper shell configured to extend around and enclose a forward part of the human foot from a forward tip receiving the toes rearwardly to a location just behind the ball of the foot, said shell having a rear edge extending over the ball of the foot;

a heel portion having a second sole portion and a second relatively rigid upper shell, said second upper shell having an access opening to permit insertion and removal of the foot, said second upper shell extending around the rear of the foot and forwardly to a location proximate the ball of the foot and having a forward edge extending over the foot, said second upper shell and said second sole portion enclosing a rearward part of the foot;

hinge means interconnecting said toe portion and said heel portion for relative rotational motion about a fixed rotational axis in an axis plane substantially parallel to the plane of the first sole portion between a flat position wherein the respective first and second planes of said first and second sole portion are substantially parallel and a flexed position wherein said first and second planes are at an angle with respect to one another, said hinge means fixedly interconnecting said toe portion and said heel portion in a manner substantially prohibiting torsional movement therebetween; and downward stop means for preventing relative angular rotational movement of said toe portion and said heel portion from said secnd position past said flat position in order to provide a hyperextension limit stop operative to prevent hyperextension of the foot.

2. An article of footwear to claim 1 including upward stop means for preventing relative angular rotational movement of said toe portion and said heel portion from said flat position past said second position in order to prevent hyperflexion of the foot upwardly and rearwardly toward the ankle.

3. An article of footwear according to claim 1 wherein downward stop means is adjustable to selectively set the hyperextension limit stop.

4. An article of footwear according to claim 3 wherein said limit stop means includes a pair of arms attached to said heel portion and projecting forwardly of the location of the hinge means, and a pair of blocks secured to said toe portion and positioned whereby each arm will advance into an abutted relation with a respective block when the heel portion is pivoted toward the flat position with respect to the toe portion to define the hyperextension limit stop, said blocks being selectively positionable to adjust the location of said limit stop.

5. An article of footwear according to claim 1 inluding means for yieldably resisting relative rotation of said toe and heel portions.

6. An article of footwear according to claim 5 wherein said means for yieldably resisting includes a relatively stiff resilient pad adapted to be inserted into the interior of said article and extending alongside said first and second sole portions from back of said heel portion to the tip of said toe portion.

7. An article of footwear according to claim 1 wherein said toe and heel portions are independent pieces having a separation region therebetween, and including a masking panel extending across the separation region beneath the foot to cover an area between said first and second sole portions.

8. An article of footwear according to claim 7 wherein said masking panel is slideably mounted with respect to at least one of said first and second sole portions.

9. An article of footwear according to claim 7 wherein said masking panel is secured to said first and second sole portions and is formed of stretchably material.

10. An article of footwear according to claim 1 wherein said hinge means includes and extension linkage whereby said toe portion is pivotally connected to a first end of said extension linkage and said heel portion is pivotally connected to a second end of said extension linkage.

11. An article of footwear according to claim 10 wherein said extension linkage comprises a pair of single links, one on each side of said toe portion, each said link having a forward end pivotally connected to the toe portion and a rearward end pivotally connected to said heel portion.

12. An article of footwear according to claim 1 wherein said hinge means includes a double plate hinge having a forward plate secured to said first sole portion, a rearward plate secured to said second sole portion and an intermediate extension plate having a forward edge pivotally connected to said forward plate and a rearward edge pivotally connected to said rearward plate.

13. An article of footwear according to claim 1 including an upper baffle extending between said first and second uppere shells and operative to cover an upper region therebetween to prevent the ingress of unwanted materials into the interior of the article.

14. An article of footwear according to claim 13 wherein said baffle has pleats to increase the flexibility thereof.

15. An article of footwear adapted to receive the human foot and operative to prevent torsional rotation of the foor while permitting bending movement about the ball of the foot, comprising:

a toe portion having a first sole portion and a first relatively rigid upper shell, said first sole portion and said first upper shell configured to extend around and enclose a forward part of the human foot from a forward tip receiving the toes rearwardly to a location just behind the ball of the foot, and shell having a rear edge extending over the ball of the foot;

a heel portion having a second sole portion formed independently of said first sole portion and a second relatively rigid upper shell, said second upper shell having an access opening to permit insertion and removal of the foot, said second upper shell extending around the rear of the foot and forwardly to a location proximate the ball of the foot and having a forward edge extending over the foot, said second upper shell and said second sole portion enclosing a rearward part of the foot;

hinge means interconnecting said toe portion and said heel portion for relative rotational motion about afixed rotational axis in an axis plane substantially parallel to the plane of the first sole portion between a flat position wherein the respective first and second planes of said first and second sole portion are substantially parallel and a flexed position wherein said first and second planes are at an angle with respect to one another, said hinge means fixedly interconnectiong said toe portion and said heel portion in a manner substantially prohibiting torsional movement therebetween; and a masking panel extending between the first and second sole portions beneath the foot and operative to prevent ingress of unwanted materials into the article of footwear through an area between said first and second sole portions.

16. An article of footwear according to claim 15 wherein said masking panel is slideable mounted with respect to at least one of said first and second sole portions.

17. An article of footwear according to claim 15 wherein said masking panel is secured to said first and second sole portions and is formed of stretchable material.

18. An article of footwear according to claim 15 including an upper baffle extending between said first and second upper shells and operative to cover an upper region therebetween to prevent the ingress of unwanted materials into the interior of the article.

19. An article of footwear adapted to receive the human foot and operative to prevent torsional rotationof the foot while permitting bending movement about the ball of the foot, conprising:

a toe portion having a first sole portion and a first relatively rigid upper shell, said first sole portion and said first upper shell configured to extend around and enclose a forward part of the human foot from a forward tip receiving the toes rearwardly to a location just behind the ball of the foot, said shell having a rear edge extending over the ball of the foot;

a heel portion a having a second sole portion formed independently of said first sole portion and a second relatively rigid upper shell, said second uppershell having an access opening to permit insertion and removal of the foot, said second upper shell extending around the rear of the foot and forwardly to a location proximate the ball of the foot and having a forward edge extendingt over the foot, said second upper shell and said second sole portion enclosing a rearward part of the foot; and hinge means interconnection said toe portion and siad heel portion for relative rotational motion about at least two rotational axes in and axis plane substantially parallel to the plane of the first sole portion between a flat position wherein the respective first and second planes of said first and second sole portion are substantially parallel and a flexed position wherein said first and second planes are at angle with respect to one another, said hinge means fixedly interconnection said toe portion and said heel portion in a manner substantially prohibiting torsional movement therebetween.

20. An article of footwear according to claim 19 wherein said hinge means includes an extension linkage whereby said toe portion is pivotally connected to a first end of said extension linkage and said heel portion is pivotally connected to a second end of said extension linkage.

21. An article of footwear according to claim 19 wherein said hinge means includes a double plate hinge having a forward plate secured to said first sole portion, a rearward plate secured to said second sole forward edge pivotally connected to said forward plate and a rearward edge pivotally connected to said rearward plate.

22. An article of footwear according to claim 19 wherein said hinge means includes a first trunnion pin hinge on said first upper shell, a second trunnion pin hinge on said second upper shell and a pair of extension links interconnection said first and second trunnion pin hinges.

* * * * *